United States Patent [19]

Okazaki

[11] 4,413,954

[45] Nov. 8, 1983

[54] SWASH-PLATE TYPE COMPRESSOR HAVING PUMPLESS LUBRICATING SYSTEM

[75] Inventor: Michio Okazaki, Konan, Japan

[73] Assignee: Diesel Kiki Co., Ltd., Saitama, Japan

[21] Appl. No.: 284,694

[22] Filed: Jul. 20, 1981

[30] Foreign Application Priority Data

Jul. 31, 1980 [JP] Japan ..... 55-105267

[51] Int. Cl.[3] ..... F04B 1/16; F04B 1/18

[52] U.S. Cl. ..... 417/269

[58] Field of Search ..... 417/269, 439

[56] References Cited

U.S. PATENT DOCUMENTS

| | | | |
|---|---|---|---|
| 2,150,487 | 3/1939 | Brown | 417/439 |
| 2,256,926 | 9/1941 | Maniscalco | 417/439 |
| 2,323,068 | 6/1943 | Maniscalco | 417/439 |
| 2,825,499 | 3/1958 | Gibson et al. | 417/269 |
| 3,215,341 | 11/1965 | Francis | 417/269 |
| 4,127,363 | 11/1978 | Kato | 417/269 |
| 4,260,337 | 4/1981 | Nomura | 417/269 |
| 4,273,518 | 6/1981 | Shibuya | 417/269 |

*Primary Examiner*—William L. Freeh

*Attorney, Agent, or Firm*—Frishauf, Holtz, Goodman and Woodward

[57] ABSTRACT

A swash-plate type compressor having a pair of passageways which each include a communication passage communicating a central opening formed in each of the valve plates mounted at opposite ends of the cylinder block with a suction opening formed in the same valve plate. The passageways each extend from the swash plate chamber to the above suction opening through the axial hole in which the drive shaft extends, the central opening and the communication passage. During the suction stroke of a piston within a cylinder bore in which the suction opening opens, oily mist in the swash plate chamber is guided in the axial hole towards the valve plates to lubricate drive shaft-supporting radial bearings mounted in the axial hole.

6 Claims, 10 Drawing Figures

SWASH-PLATE TYPE COMPRESSOR HAVING PUMPLESS LUBRICATING SYSTEM

BACKGROUND OF THE INVENTION

This invention relates to a swash-plate type compressor for compressing a refrigerant or the like, and more particularly to improvements in a lubricating oil feed system provided in such type compressor and employing no oil pump.

A swash-plate type compressor in general is constructed such that pistons are reciprocally moved within cylinder bores in unison with rotation of a swash plate obliquely secured on a drive shaft, to perform compressing actions in cooperation with suction valves and discharge valves. The drive shaft and the swash plate are rotatably supported by thrust bearings which are disposed to bear thrust loads as well as by radial bearings which are disposed to bear radial loads.

Such conventional swash-plate type compressor was provided with a lubricating oil feed system of the so-called "oil pump type" for supplying lubricating oil to the the thrust bearings and the radial bearings, which comprises an oil pump mounted at an end of the drive shaft and operable during rotation of the drive shaft to force lubricating oil from an oil sump provided below the swash plate chamber and feed it to the bearings through an oil feeding passageway extending in the drive shaft along its axis. However, the oil pump is rather expensive and requires special power to drive same. For this reason, lubricating oil feed systems without such an oil pump have recently been employed.

These conventional pumpless type systems include a differential pressure type. According to this type, lubricating oil in the oil sump below the swash plate chamber is splashed upwardly into oily mist by the outer fringe of the swash plate during its rotation so that refrigerant with the oily mist entrained therein is guided, due to a pressure difference between the swash plate chamber and low pressure chambers in the compressor, through oil feeding passageways leading to the low pressure chambers through the thrust bearings, the gap between the drive shaft and the cylinder block and the radial bearings. The above pressure difference between the swash plate chamber and the low pressure chamber is produced by a plenum caused by blow-bye gas introduced into the swash plate chamber through the gaps between the pistons and the cylinder bores during the discharge strokes of the pistons. Therefore, when the amount of such blow-bye gas produced is still small, namely, at the start of the compressor of during low speed operation thereof, a sufficient pressure difference is not obtained between the swash plate chamber and the low pressure chambers. Further, as known, the thrust bearings rotate about their own axes as the drive shaft, which is supported by them, rotates so that during high speed operation oily mist undergoes large flow resistance immediately before passing the thrust bearings due to centrifugal force caused by the rotation of the thrust bearings. owing to these facts, the conventional differential pressure type oil feed system is not capable of feeding a sufficient amount of lubricating oil to the bearings, particularly to the radial bearings on the above-mentioned occasions.

OBJECT AND SUMMARY OF THE INVENTION

It is therefore the object of the invention to provide a swash-plate type compressor which is provided with a lubricating oil feed system which is capable of feeding a sufficient amount of lubricating oil to the radial bearings in particular all the time during operation of the compressor, due to provision of communication passages which each communicate the axial hole in which the drive shaft extends with a suction opening bored through a valve plate for compression medium to be sucked through, whereby oily mist produced in the swash plate chamber is forcedly guided toward the valve plate due to a pressure drop produced in the communication passage by a flow of compression medium passing through the suction opening to lubricate the radial bearing and other moving parts.

According to the invention, a swash-plate type compressor is provided which is formed with a pair of passageways which each include a communication passage communicating a central opening formed in each of the valve plates mounted at opposite ends of the cylinder block with at least one of the suction openings formed in the valve plate. The passageways each extend from the swash plate chamber to the above at least one suction opening through the axial hole in which the drive shaft extends, the central opening and the communication passage. During the suction stroke of a piston within a cylinder bore in which at least one suction opening opens, oily mist in the swash plate chamber is guided in the axial hole towards the valve plates to lubricate radial bearings in particular, mounted in the axial hole and supporting the drive shaft.

The above communication passages each may be formed by a bore bored through the valve plate, or alternatively may be defined by a groove formed in either one of an outer end face of the valve plate and a surface of a gasket closely attached to the outer end face of the valve plate and by the other one of the end face and the surface.

The above and other objects, features and advantages of the invention will be more apparent from the ensuing detailed description taken in connection with the accompanying drawings.

DETAILED DESCRIPTION

Figure 1:
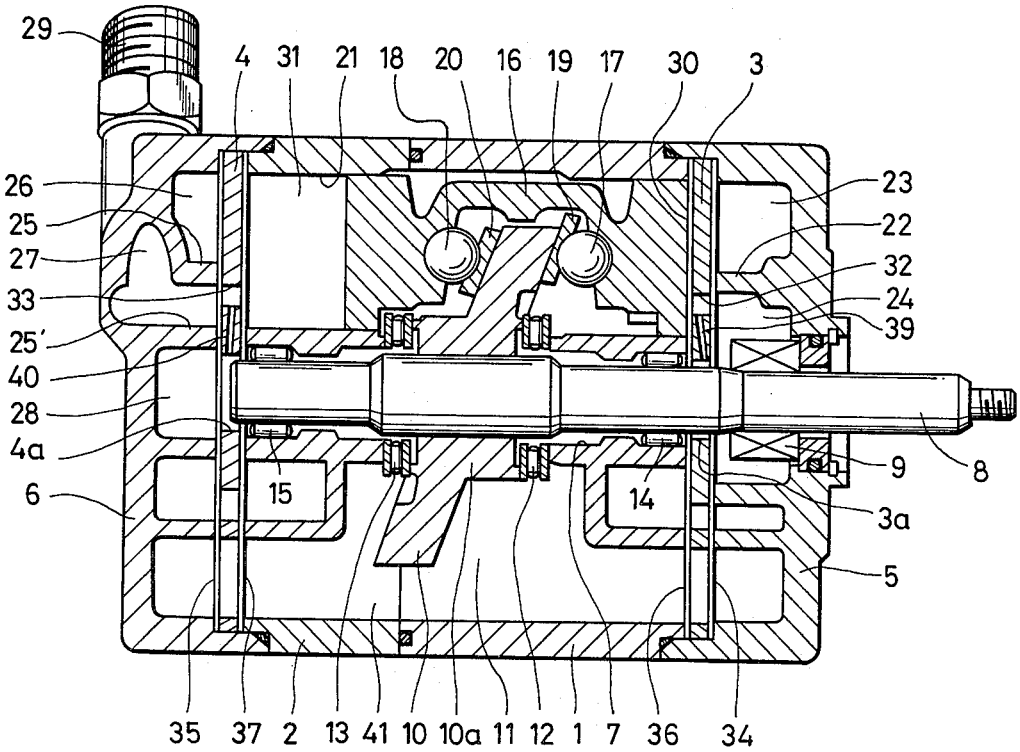
FIG. 1 is a longitudinal section view illustrating as a whole a swash-plate type compressor according to a first embodiment of the invention.

The present invention will now be described with reference to the drawings wherein several embodiments of the invention are illustrated. In the drawings, like reference characters designate like or corresponding parts throughout all the views.

Figure 2:
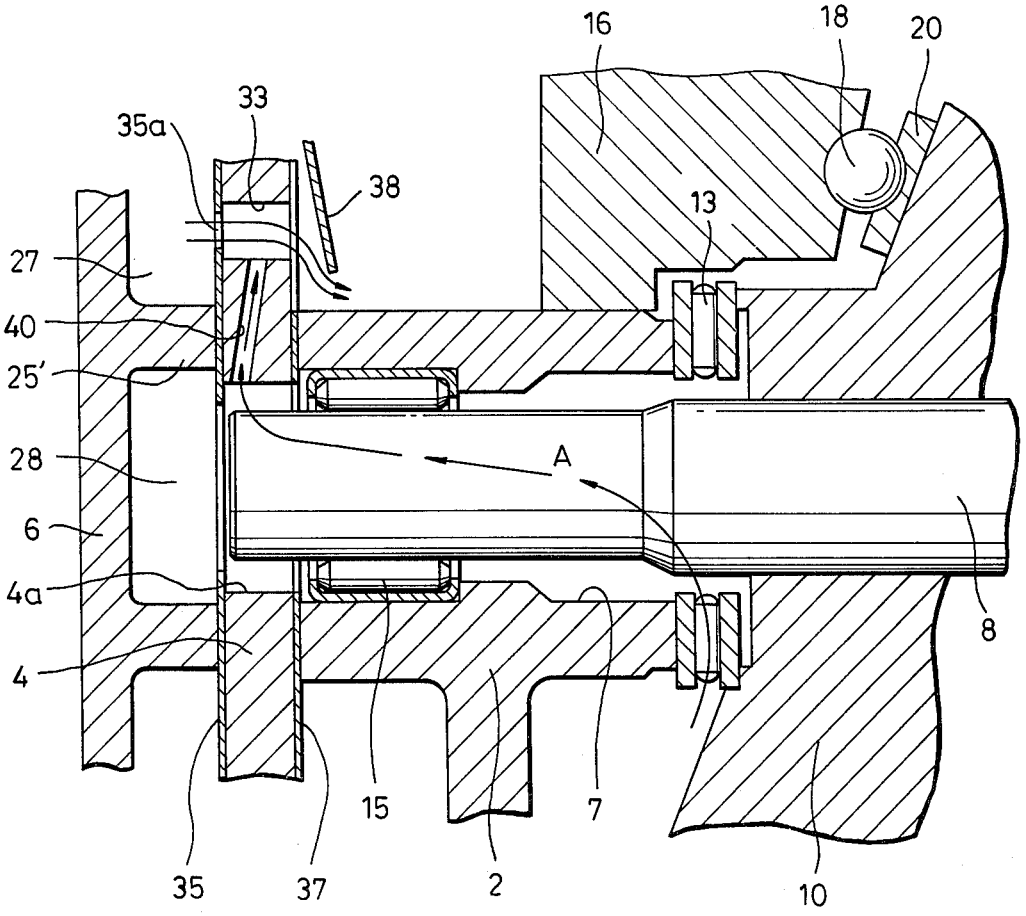
FIG. 2 is an enlarged sectional view illustrating essential part of the compressor of FIG. 1.

Referring first to FIGS. 1 and 2, there is illustrated a first embodiment of the invention. A pair of cylindrical members 1, 2 are combined together in axial alignment to form a cylinder block. Front and rear cylinder heads 5, 6 are secured to the opposite ends of the combined cylindrical members 1, 2 with valve plates 3, 4 intervening between the cylinder heads 5, 6 and the cylindrical members 1, 2, in a manner keeping the interior of the cylinder block fluidtight. The combined cylindrical members 1, 2 and the valve plates 3, 4 are formed, respectively, with an axial hole 7 and central openings 3*a*, 4*a* extending through their centers. The central openings 3*a*, 4*a* are aligned with and communicates with the axial hole 7. A drive shaft 8 is inserted in the axial hole 7 and the central openings 3*a*, 4*a*, with slight gaps defined between the drive shaft and these hole and openings. The central opening 4*a* on the rear side may be designed smaller in diameter than the axial hole 7 so that the associated end of the drive shaft 8 is not inserted in this opening 4*a*. The drive shaft 8 has its front end projected outwardly of the front cylinder head 5, on which is to be mounted a driving force transmission device, not shown. A mechanical seal 9 is provided on a portion of the drive shaft 8 within the front cylinder head 5 to seal the shaft.

A swash plate 10 is secured on the drive shaft 8 and located in a swash plate chamber 11 defined in and between the combined cylindrical members 1, 2. The swash plate 10 and the drive shaft 8 are supported by thrust bearings 12, 13 mounted at the opposite ends of the boss 10*a* of the swash plate 10 and radial bearings mounted in the axial hole 7 near its opposite ends, respectively, for rotation relative to the cylinder block.

Double acting pistons 16, which are three, for instance, and only one of which is shown, are slidably inserted within cylinder bores 21 which are three, for instance, and only one of which is shown, for reciprocating movements within the respective cylinder bores 21 in unison with the rotation of the swash plate 10. The double acting pistons 16 each have its central portion formed with a radially inwardly facing recess in which the swash plate 10 is engaged by means of balls 17, 18 and shoes 19, 20 intervening therebetween. The cylinder bores 21 are arranged at circumferentially equal intervals and extend parallel with the axial hole 7. The front cylinder head 5 is formed with a partition wall 22 which cooperates with the valve plate 3 to divide the interior of the cylinder head 5 in a high pressure chamber 23 and a low pressure chamber 24. The aforementioned mechanical seal 9 is arranged within the low pressure chamber 24. Similarly, the rear cylinder head 6 has its interior divided by a partition wall 25 in a high pressure chamber 26 and a low pressure chamber 27 in cooperation with the valve plate 4. Further formed in the interior of the cylinder head 6 is a chamber 28 which is partitioned from the low pressure chamber 27 by means of another partition wall 25' and communicates with the axial hole 7 via the central opening 4*a* of the valve plate 4. The high pressure chamber 23 and the low pressure chamber 24 in the front cylinder head 5 are communicated with the high pressure chamber 26 and the low pressure chamber 27 in the rear cylinder head 6 through refrigerant passages, not shown, formed through the cylinder block, respectively. Refrigerant gas is sucked into the low pressure chamber 24, 27 through a suction connector 29 formed on the rear cylinder head 6 and temporarily stored therein, whereas discharge refrigerant gas is temporarily stored in the high pressure chambers 23, 26.

The valve plates 3, 4 are formed with discharge openings, not shown, which can communicate the high pressure chambers 23, 26 with compression chambers 30, 31 to be defined at the opposite ends of the pistons 16, and suction openings 32, 33 which can communicate the low pressure chambers 24, 27 with the above compression chambers 30, 31, the discharge openings and the suction openings 32, 33 being arranged in facing relation to the respective cylinder bores 21. Closely attached to the end faces of the valve plates 3, 4 facing the cylinder heads 5, 6 are sealing gaskets 34, 35 which may be made of a metal material or a metal material lined with a resilient material such as rubber, while sealing gaskets 36, 37, which may be made of rubber, are closely attached to the other end faces of the valve paltes 3, 4 facing the cylindrical members 1, 2. The above discharge openings are adated to be closed by discharge valves, not shown, mounted on the valve plates 3, 4, and the above suction openings 32, 33 by suction valves 38 also mounted on the valve plates 3, 4, respectively. The valves 38 are formed integrally with the gaskets 36, 37. As the pistons 16 are reciprocatingly moved within the cylinder bores 21, the compression chambers 30, 31 have their volumes changed so that during the suction strokes of the pistons 16, the suction valves 38 are opened to allow refrigerant gas to be sucked into the compression chambers 30, 31 from the low pressure chambers 24, 27 through the suction openings 32, 33, while during the discharge strokes of the pistons 16, the discharge valves are opened to allow compressed refrigerant to be discharged into the high pressure chambers 23, 26 through the discharge openings in the valve plates 3, 4.

Oil suction holes 39, 40 are bored in the valve plates 3, 4 as communication passages communicating the central openings 3*a*, 4*a* with some of the suction openings 32, 33 facing, for instance, one of the cylinder bores 21. As clearly shown in FIG. 2, the oil suction holes 39, 40 each have one end opening in the inner peripheral surface of the suction opening 32, 33. When suction refrigerant gas passes the suction openings 32, 33, there occur pressure drops in the oil suction holes 39, 40 which are proportional to the square of the velocity of the refrigerant gas flow passing the suction openings 32, 33. Those suction openings 32, 33 which are communicated with the central openings 3*a*, 4*a* by means of the oil suction holes 39, 40 may advantageously be designed smaller in diameter than the other suction openings formed in the valve plates to enhance the degree of pressure drops due to correspondingly increased velocity of the refrigerant gas flow.

An oil sump 42 is formed in the cylinder block below the swash plate chamber 11 and extends as far as the front and rear cylinder heads 5, 6. The swash plate 10 has its outer fringe immersed in the lubricating oil stored in the oil sump 41.

During rotation of the swash plate 10, the lubricating oil in the oil sump 41 is splashed upwardly by the outer fringe of the swash plate 10 into oily mist. At the start of operation of the compressor, the swash plate chamber 11 undergoes a sudden pressure drop, since it communicates with the suction openings 32, 33 through the axial hole 7, the central openings 3a, 4a and the oil suction holes 39, 40. This sudden pressure drop causes boiling of the refrigerant gas entrained in the lubricating oil in the oil sump 41 into foam so that the swash plate chamber 11 is filled with foamy refrigerant with lubricating oil entrained therein.

Two oil feeding passageways A are defined which extend from the swash plate chamber 11 to the suction openings 32, 33 through the thrust bearings 12, 13, the gaps between the cylindrical members 1, 2 and the drive shaft 8, the radial bearings 14, 15, the central openings 3a, 4a and the oil suction holes 39, 40.

With the above arrangement, when the drive shaft 8 rotates, the swash plate 10 is swingingly rotated correspondingly, to cause reciprocating motions of the pistons 16 within the respective cylinder bores 21 to carry out refrigerant compressing actions in cooperation with the suction valves 38 and the discharge valves, not shown. Suction refrigerant gas, which usually contains lubricating oil in several percent, is sucked into the compression chambers 30, 31 from the low pressure chambers 24., 27 to lubricate the gaps between the pistons 16 and the cylinder bores 21. As the pistons 16 are moved through their discharge strokes, the refrigerant in the compression chambers 30, 31 is discharged, but part of the compressed refrigerant is leaked as blow-bye gas into the swash plate chamber 11 through the gaps between the pistons 16 and the cylinder bores 21. Since the swash plate chamber 11 is relatively large in volume, the lubricating oil entrained in the blow-bye gas is separated from the refrigerant in the chamber 11 and temporarily stored in the oil sump 41. Then, during rotation of the swash plate 10, the lubricating oil in the oil sump 41 is splashed by the swash plate 10 into oily mist to be fed to the shoes 19, 20, the balls 17, 18, the thrust bearings 12, 13, etc. to lubricate these parts. Further, the oily mist is fed together with the refrigerant floating in the swash plate chamber 11 to the radial bearings 14, 15 through the oil feeding passageways A. More specifically, the oil feeding passageways A each have its one end opening in its associated suction opening 32, 33, so that a pressure drop is caused in the oil suction hole 39, 40 by a flow of refrigerant gas being sucked into the compression chamber 30, 31 from the low pressure chamber 24, 27 through the suction opening 32, 33. That is, due to small diameters of the suction openings 32, 33 which are much smaller than the diameter of the cylinder bores 21, the flow velocity of the refrigerant gas is increased while passing the openings 32, 33 to such an extent that a large pressure drop takes place in the oil suction holes 39, 40, which is transmitted to the oil feeding passageway A.

Due to the resulting large pressure difference between the oil feeding passageway A and the swash plate chamber 11, an adequate amount of the oily mist floating in the swash plate chamber 11 is sucked into the passageway A to be fed to the radial bearing 14, 15 in the axial hole 7. On this occasion, the oily mist undergoes centrifugal force caused by the rotation of the thrust bearing 12, 13 which in turn is caused by the rotation of the drive shaft 8, immediately before it passes the thrust bearing 12, 13. However, suction force which occurs due to the above-mentioned pressure drop overcomes this centrifugal force to allow a sufficient amount of oily mist to be fed to the radial bearing 14, 15.

Incidentally, the front cylinder head 6 may be provided with a partition wall similar to the partition wall 25' in the rear cylinder head 5 to define a mechanical seal-accommodated chamber.

Figure 4:
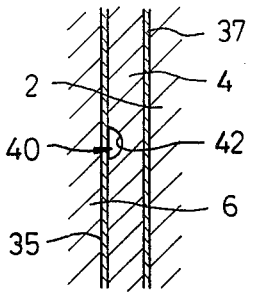
FIG. 4 is a sectional view taken along line IV—IV in FIG. 3.
Figure 3:
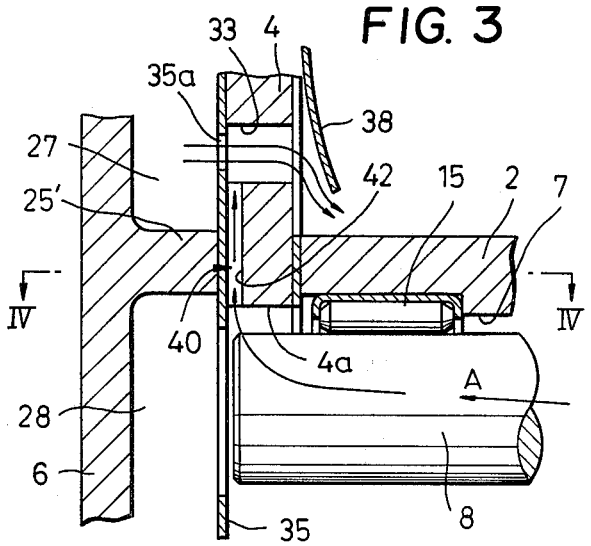
FIG. 3 is a fragmentary sectional view illustrating a second embodiment of the invention.

Referring next to FIGS. 3 and 4, there is shown a second embodiment of the invention. This embodiment is distinguished form the aforementioned first embodiment in the manner of forming the oil suction holes 39, 40. The holes 39, 40 are each defined by a groove 42 formed in the outer end face of its associated valve plate 3, 4 and in a surface of a gasket 34, 35 closely attached to the above outer end face on the side of the cylinder head 5, 6, and have one end opening in the inner peripheral surface of the suction opening 32, 33.

Figure 6:
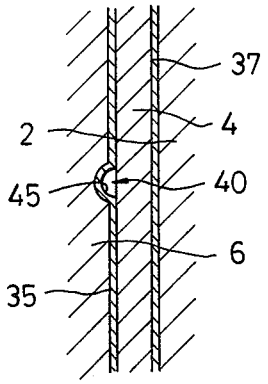
FIG. 6 is a sectional view taken along line VI—VI in FIG. 5.
Figure 5:
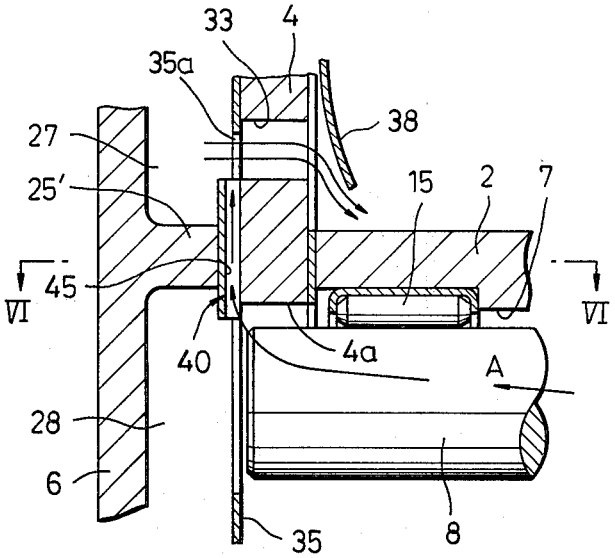
FIG. 5 is a fragmentary sectional view illustrating a third embodiment of the invention.

Referring further to FIGS. 5 and 6, there is shown a third embodiment of the invention. According to this embodiment, the oil suction holes 39, 40 are formed in a contrary manner to that in the above second embodiment, that is, each defined by the outer end face of the valve plate 3, 4 and a groove 45 formed in the surface of the gasket 34, 35 closely attached to the above outer end face on the side of the cylinder head 5, 6.

Figure 7:
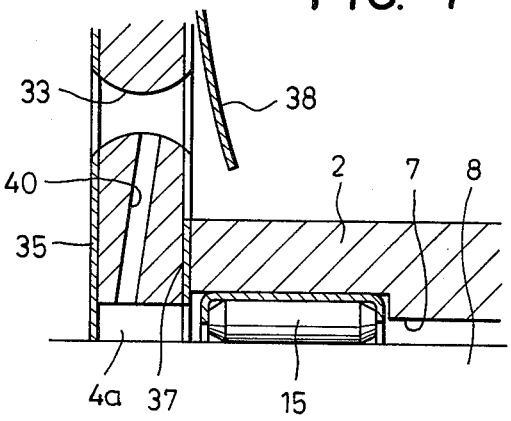
FIG. 7 is a fragmentary sectional view illustrating a fourth embodiment of the invention.

FIG. 7 further illustrates a fourth embodiment of the invention. While in the preceding embodiments the suction openings 32, 33 have their openings substantially restricted by the peripheral edges of openings 34a, 35a formed in the gaskets 34, 35 on the cylinder head 5, 6 and having smaller diameters than those of the openings 32, 33, the suction openings 32, 33 according to this embodiment each have its axially central peripheral surface portion smaller in diameter at which the associated oil suction hole 39, 40 opens in the opening 32, 33 to achieve higher flow velocity of the suction refrigerant gas.

Figure 8:
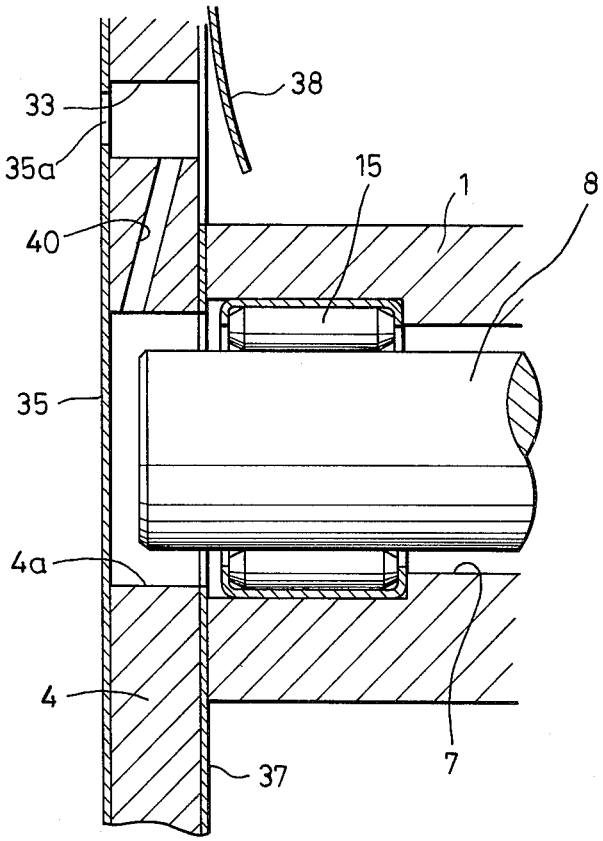
FIG. 8 is a fragmentary sectional view illustrating a fifth embodiment of the invention.

FIG. 8 illustrates a fifth embodiment of the invention. While in the preceding embodiments the axial hole 7 is separated from the low pressure chamber 27 on the rear side by means of the partition wall 25' formed in the rear cylinder head 6, such separation is realized by the gasket 35 on the side of the rear cylinder head 6 as shown in FIG. 8, according to this embodiment.

The second through fifth embodiments can all achieve similar lubrication effects to that obtained by the first embodiment previously described.

Figure 9:
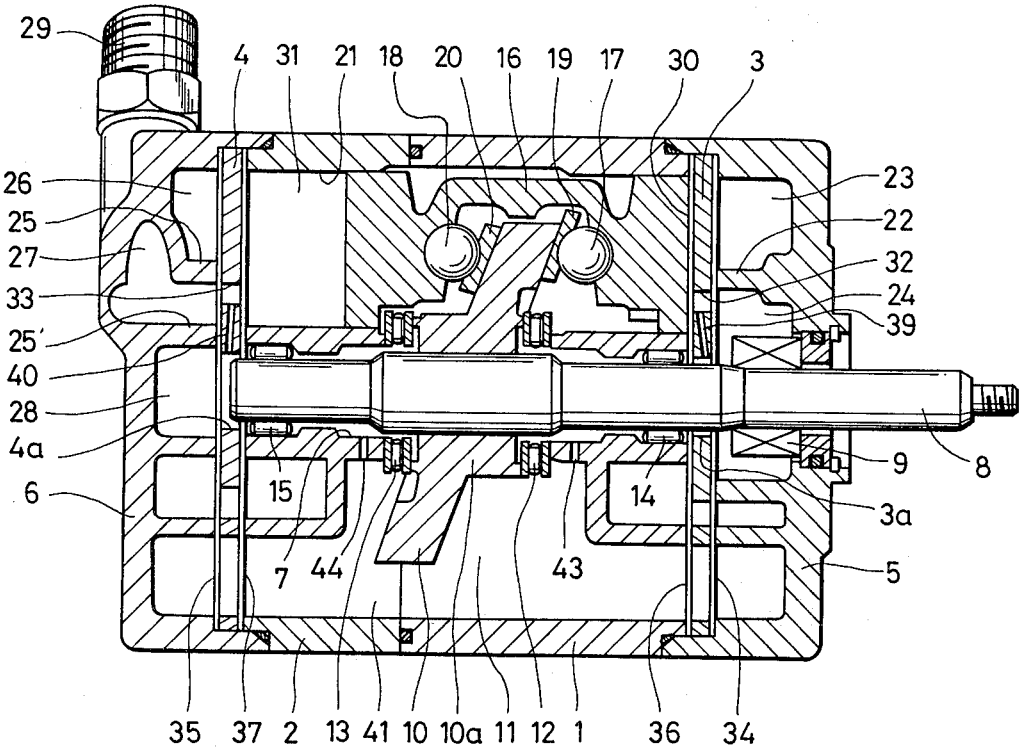
FIG. 9 is a longitudinal sectional view illustrating as a whole a swash-plate type compressor according to a sixth embodiment of the invention.
Figure 10:
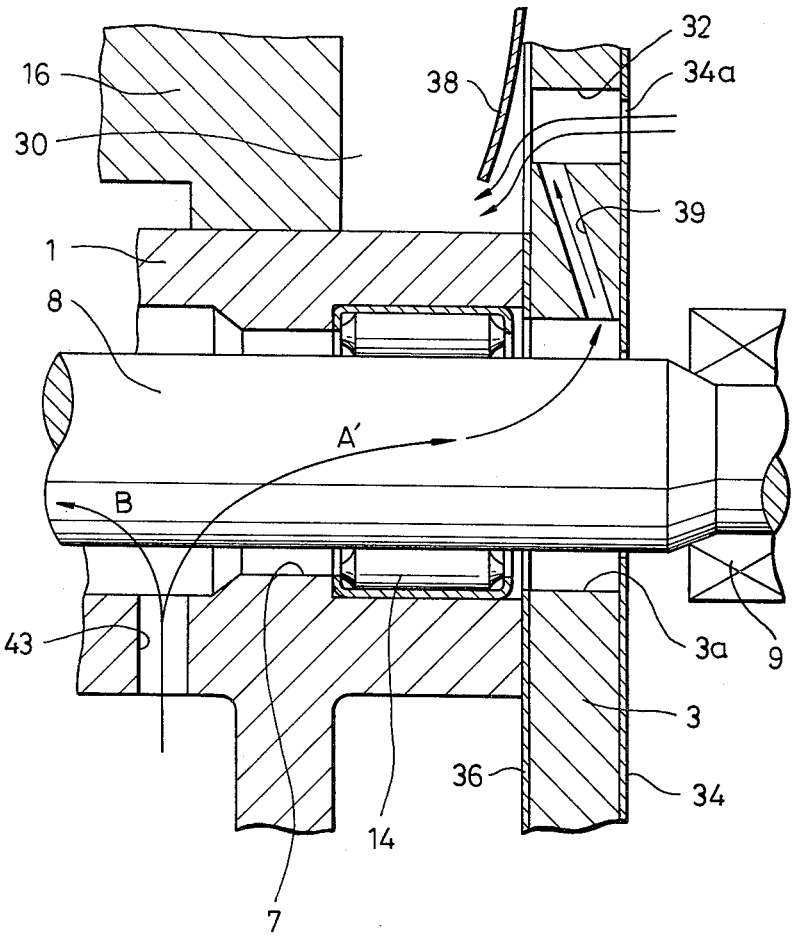
FIG. 10 is an enlarged sectional view illustrating essential part of the compressor of FIG. 9.

Referring to FIGS. 9 and 10, a sixth embodiment of the invention is illustrated. This embodiment is distinguished from the aforedescribed first embodiment in that oil feeding holes 43, 44 are formed in the respective cylindrical members 1, 2 at locations between the thrust bearings 12, 13 and the radial bearings 14, 15, to communicate the swash plate chamber 11 with the axial hole 7.

The oil suction holes 39, 40 are formed in the valve plates 3, 4 to communicate the central openings 3a, 4a which in turn communicate with the axial hole 7, with the suction openings 32, 33, like the first embodiment.

According to this embodiment, oil feeding passageways A' are provided which each extend from the swash plate chamber 11 to the suction opening 32, 33 through the oil feeding hole 43, 44, the gap between the drive shaft 8 and the cylindrical member 1, 2, the radial bearing 14, 15, the central opening 3a, 4a and the oil suction hole 39, 40. Further formed are oil feeding passageways B which each extend from the swash plate chamber 11 to the thrust bearing 12, 13 through the oil feeding hole 43, 44 and the gap between the drive shaft 8 and the cylindrical member 1, 2.

With this arrangement, the oily mist in the swash plate chamber 11 is fed to the radial bearings 14, 15 through the oil feeding holes 43, 44 along the oil feeding passageways A' at a relatively large rate as compared with the preceding embodiments, to thus enable more sufficient lubrication of the radial bearings 14, 15. Incidentally, the thrust bearings 12, 13 can be sufficiently lubricated by oily mist directly fed thereto from the swash plate chamber 11, as well.

While the invention has been particularly shown and described with reference to preferred embodiments thereof, it will be understood by those skilled in the art that foregoing and other changes in form and details can be made therein without departing from the spirit and scope of the invention.

What is claimed is:

1. A swash-plate type compressor which comprises:

a cylinder block having an axial hole extending along an axis thereof, a plurality of cylinder bores axially extending therethrough in circumferentially spaced arrangement, and a swash plate chamber defined therein at a substantially axial center thereof;

a drive shaft inserted in said axial hole in said cylinder block;

a plurality of pistons slidably mounted within said cylinder bores;

a swash plate secured on said drive shaft at a boss thereof, said swash plate being arranged within said swash plate chamber;

a pair of valve plates mounted at opposite ends of said cylinder block, said valve plates each having a central opening aligned with and communicating with said axial hole, a plurality of suction openings each opening in an associated one of said cylinder bores in said clyinder block, said drive shaft extending through said central opening in at least one of said valve plates;

a pair of thrust bearings mounted at opposite ends of said boss of said swash plate for bearing thrust loads applied to said swash plate;

a pair of radial bearings mounted in said axial hole in said cylinder block at locations close to opposite ends of said axial hole for supporting said drive shaft in radial directions; and a pair of passageways each including a communication passage, said communicating passage having one end opening in said central opening of an associated one of said valve plates and the other end opening in at least one of said suction openings of said associated one of said valve plates, said passageways each extending from said swash plate chamber to said at least one of said suction openings through said axial hole, said central opening and said communication passage;

wherein said at least one of said suction openings has a diameter smaller than that of an associated one of said cylinder bores such that as refrigerant passes said at least one suction opening it has a flow velocity thereof increased to a value enough to cause a considerable pressure drop in said communication passage during the suction stroke of an associated one of said pistons within said associated cylinder bore, whereby oily mist in said swash plate chamber is guided through said axial hole, said central opening, said communication passage and said at least one suction opening into said associated cylinder bore due to an increased pressure difference between the internal pressure of said swash plate chamber and pressure in said communication passage, which is caused by said pressure drop in said communication passage.

2. The swash-plate type compressor as claimed in claim 1, wherein said passageways each include at least one hole formed in said cylinder block and communicating said swash plate chamber with said axial hole in said cylinder block, said at least one hole being located between an associated one of said thrust bearings and an associated one of said radial bearings.

3. The swash-plate type compressor as claimed in claim 1 or claim 2, wherein said at least one suction opening has an inner peripheral surface, and said communication passage comprises a bore formed in said associated one of said valve plates and having one end opening in said inner peripheral surface of said at least one suction opening.

4. The swash-plate type compressor as claimed in claim 1 or claim 2, wherein said at least one suction opening has an inner peripheral surface, and said communication passage is defined by a groove formed in an outer end face of said associated one of said valve plates and a surface of a gasket closely attached to said outer end face of said associated one of said valve plates, said groove having one end opening in said inner peripheral surface of said at least one suction opening.

5. The swash-plate type compressor as claimed in claim 1 or claim 2, wherein said communication passage is defined by an outer end face of said associated one of said valve plates and a groove formed in a surface of a gasket closely attached to said outer end face of said associated one of said valve plates.

6. The swash-plate type compressor as claimed in claim 1 or claim 2, wherein said at least one of said suction openings in said associated one of said valve plates has a substantially axial central portion thereof smaller in diameter than other axial portions thereof.

* * * * *